US010319514B2

(12) United States Patent
Takagi et al.

(10) Patent No.: US 10,319,514 B2
(45) Date of Patent: Jun. 11, 2019

(54) COIL DEVICE

(71) Applicant: TDK CORPORATION, Tokyo (JP)

(72) Inventors: Nobuo Takagi, Tokyo (JP); Kazuteru Kakizaki, Tsuruoka (JP); Setu Tsuchida, Tsuruoka (JP)

(73) Assignee: TDK CORPORATION, Tokyo (JP)

( * ) Notice: Subject to any disclaimer, the term of this patent is extended or adjusted under 35 U.S.C. 154(b) by 3 days.

(21) Appl. No.: 15/422,009

(22) Filed: Feb. 1, 2017

(65) Prior Publication Data

US 2017/0229232 A1 Aug. 10, 2017

(30) Foreign Application Priority Data

Feb. 4, 2016 (JP) ..... 2016-019927

(51) Int. Cl.

| | |
|---|---|
| ***H01F 27/02*** | (2006.01) |
| ***H01F 27/29*** | (2006.01) |
| ***H01F 27/28*** | (2006.01) |
| ***H01F 27/24*** | (2006.01) |
| ***H01F 27/30*** | (2006.01) |

(52) U.S. Cl.

CPC ..... *H01F 27/29* (2013.01); *H01F 27/24* (2013.01); *H01F 27/2823* (2013.01); *H01F 27/306* (2013.01)

(58) Field of Classification Search

USPC ..... 336/90, 200, 232, 83

See application file for complete search history.

(56) References Cited

U.S. PATENT DOCUMENTS

| | | | | |
|---|---|---|---|---|
| 2009/0104469 | A1* | 4/2009 | Lin | B22F 3/1291 428/557 |
| 2010/0271162 | A1* | 10/2010 | Yan | H01F 17/04 336/98 |
| 2014/0002227 | A1* | 1/2014 | Hsieh | H01F 27/022 336/200 |
| 2016/0234979 | A1* | 8/2016 | Lee | H01G 4/40 |
| 2016/0247626 | A1* | 8/2016 | Kawarai | H01F 27/29 |

FOREIGN PATENT DOCUMENTS

| | | |
|---|---|---|
| JP | H05-315176 A | 11/1993 |
| JP | 2003-217941 A | 7/2003 |

* cited by examiner

*Primary Examiner* — Elvin G Enad
*Assistant Examiner* — Kazi S Hossain
(74) *Attorney, Agent, or Firm* — Oliff PLC

(57) ABSTRACT

A coil device comprising; a winding coil including Cu and having a winding part and an extension line part which is pulled out from said winding part, a pair of electrodes made of a conductive material having, a connecting wire part having a connecting wire face connected with the extension line part and a protective face sandwiching said extension line part with said connecting wire face, and a base part provided with a mounting base face at one of the faces of the base and connected to said connecting wire part, a magnetic part including a magnetic material and covering at least said winding part and said connecting wire part.

7 Claims, 8 Drawing Sheets

COIL DEVICE

BACKGROUND OF THE INVENTION

1. Field of the Invention

The present invention relates to a coil device used as an inductance element or so, and more specifically the present invention relates to the coil device comprising a winding coil covered by a magnetic material.

2. Description of the Related Art

In various electronic and electric devices, many coil devices are installed as the inductance element or a trance. As such coil devices, those comprising the electrodes which can be mounted on the surface using a robot or so, and the winding coil connected to said electrodes being covered by a magnetic part having the magnetic material is proposed (Patent document 1: JP Patent Application Laid Open No. 2003-217941, and Patent document 2: JP Patent Application Laid Open No. H05-315176).

SUMMARY OF THE INVENTION

As such coil devices, there is a coil device wherein the connecting part between the electrode and the winding coil covered with the magnetic material (for example see the patent document 1), and also a coil device wherein the connecting wire part between the electrode and the winding coil exposed from the magnetic material (for example see the patent document 2). However, for the conventional coil device wherein the connecting part is covered with the magnetic material, when the electrode is applied with heat during the reflow or so which is carried out when surface mounting the coil device, the bonding condition between the electrode and the winding coil, or between the electrode and the magnetic material may deteriorate. Also, for the conventional coil device wherein the connecting wire part between the electrode and the winding coil is exposed, the connecting wire part tends to receive the impact from the outside, and also the production variation relating to the outer shape varied largely.

The present invention was attained in view of such circumstances, and the object is to provide the coil device with high reliability in regards with the connecting condition between the winding coil and the electrode.

Means for Attaining the Object

In order to achieve the above object, the coil device according to the present invention comprises;

a winding coil including Cu and having a winding part and an extension line part which is pulled out from said winding part, a pair of electrodes made of a conductive material having, a connecting wire part having a connecting wire face connected with the extension line part and a protective face sandwiching said extension line part with said connecting wire face, and a base part provided with a mounting base face at one of the faces of the base and connected to said connecting wire part, a magnetic part including a magnetic material and covering at least said winding part and said connecting wire part.

In the coil device according to the present invention, the magnetic part covers the connecting wire part, and the connecting wire part is protected from the impact or so from the outside by the magnetic part, hence the coil device of the present invention has good durability and reliability. Further, since the extension line part is placed between the protective face and the connecting wire face, the area in contact with the magnetic part with respect to the connecting part of the extension line part is reduced compared to the case without the protective face. Therefore, such coil device can prevent from receiving the force trying to pull apart the connecting part of the extension line part from the electrode, which is caused by the difference between the linear expansion coefficient. Also, the protective face has an effect to protect the connecting part between the extension line part and the electrode from the residual stress generated during the molding of the magnetic part. Therefore, the coil device according to the present invention has high reliability in regards with the connecting condition of the winding coil and the electrode.

Also, for example, said protective face is bended so as to cover said extension line part in circumferential direction, said extension line part is placed between said connecting wire face and said protective face, and said protective face is continuous with said connecting wire face.

In such coil device, due to the connecting wire face and the bended protective face, the connecting part between the extension line part and the electrode is protected, and thereby the reliability regarding the connecting condition between the winding coil and the electrode can be enhanced. Also, because the connecting wire face and the protective face are continuous, by placing the extension line part at the connecting wire part, the reliability regarding the connecting condition between the winding coil and the electrode can be enhanced. Also, by using the connecting wire face and the protective face which are continuous, the extension line part can be easily fixed temporarily to the connecting wire during the production, thus such coil device can be easily produced.

For example, said connecting wire part may comprise the bending part, and said connecting wire face may be connected to said base part via said bending part.

The electrode comprising such connecting wire part can be easily produced since there are only few bonding sections, hence has excellent productivity.

Also, for example, said connecting wire part may have the conductor piece made of a conductive material and provided on said connecting wire face, said conductor piece may be fixed to said base part via the bonding part bonding said conductor piece and said base part.

In such coil device, by constituting the connecting wire face using the conductor piece which is originally separate member from the base part, the material of the connecting wire face can be different with respect to the mounting face or so, hence the reliability regarding the connecting condition between the winding coil and the electrode can be enhanced.

Also, for example, at least part of said electrode is formed with Sn layer including Sn, and said mounting base face may be constituted by said Sn layer.

The coil device wherein said mounting base face is constituted by Sn layer has good bonding property between the electrode and the solder which is used for surface mounting.

Also, for example, said connecting wire part may have the conductor piece made of a conductive material and provided on said connecting wire face, said base part comprises Ag part including Ag, Ni layer including Ni, and Sn layer including Sn, said Sn layer is bonded to said Ag part via said Ni layer, and said mounting base face may be constituted from said Sn layer.

The Ag part including Ag has good bonding property with the magnetic part, and also by bonding the Sn layer to the Ag part via the Ni layer, the Sn layer can be prevented from being released. Also, the coil device wherein the mounting base face is constituted from the Sn layer shows good bonding property between the electrode and the solder which is used for the surface mounting. Also, by constituting the connecting wire face using the conductor piece which was originally separate from the base part, the material of the connecting wire face is changed with respect to the mounting face or so, and the reliability relating to the connection between the winding coil and the electrode can be improved.

Also, for example said connecting wire face may be approximately parallel with said mounting base face.

In the coil device wherein the connecting wire face and the mounting base face are approximately parallel, the step which connects the extension line part to the connecting wire face can be done easily; hence such coil device has excellent productivity.

Also, for example, said magnetic part may comprise a first magnetic part which at least part of said first magnetic part is positioned at inside of said winding part and other part of said first magnetic part is positioned between said winding part and said base part, and a second magnetic part covering said winding part and said connecting wire face, and said first magnetic part may have larger content of the magnetic material per unit area than said second magnetic part.

The first magnetic part does not need to cover other part, hence the content of the resin or so can be less than the second magnetic part; on the other hand the content of the magnetic material can be larger. Therefore, in such coil device, the magnetic characteristic of the magnetic part can be enhanced, and thereby the inductance or so can be improved.

DESCRIPTION OF THE PREFERRED EMBODIMENTS

Hereinafter, the present invention will be explained based on the embodiment shown in the figure.

Figure 1:
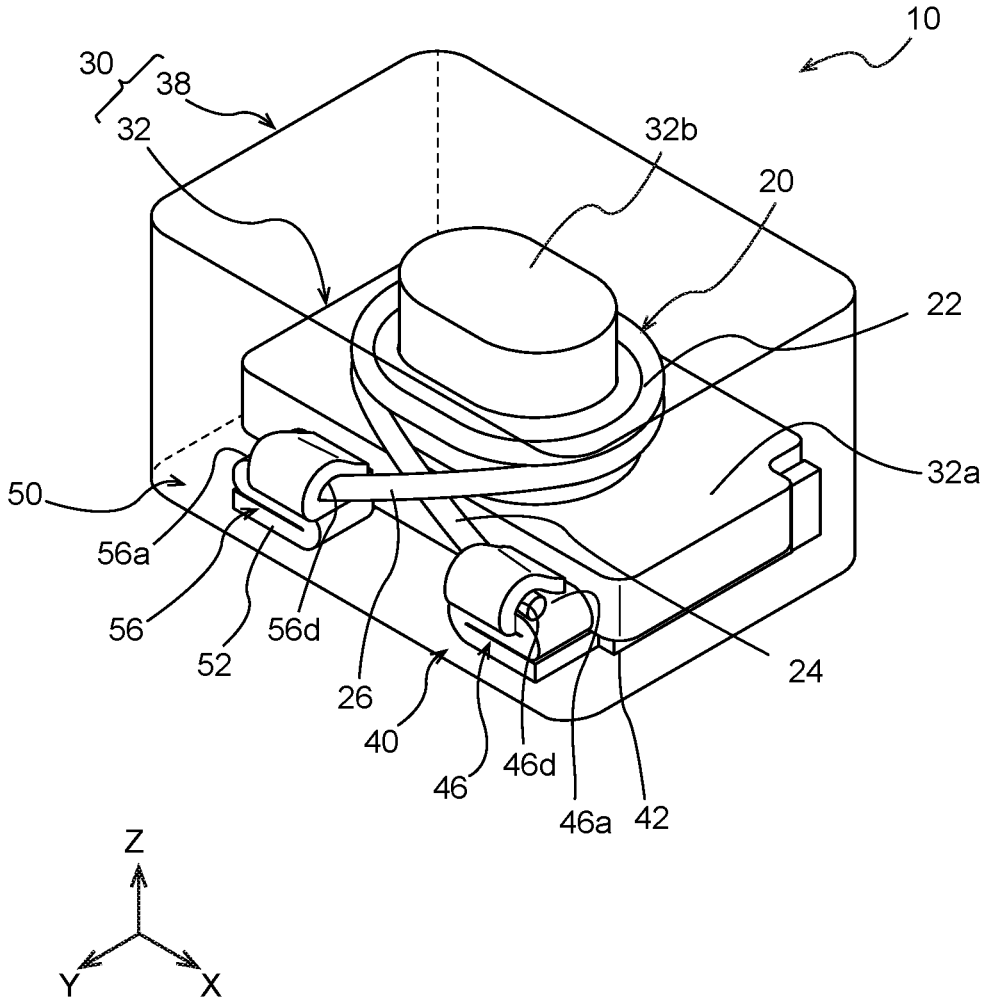
FIG. 1 is a perspective view of the coil device according to one embodiment of the present invention, and a part of the magnetic part is shown transparently.

FIG. 1 is the schematic perspective view of the coil device 10 according to one embodiment of the present invention, and the second magnetic part 38 is shown transparently. The coil device 10 comprises the winding coil 20, the magnetic part 30, and a pair of electrodes 40 and 50.

Figure 4:
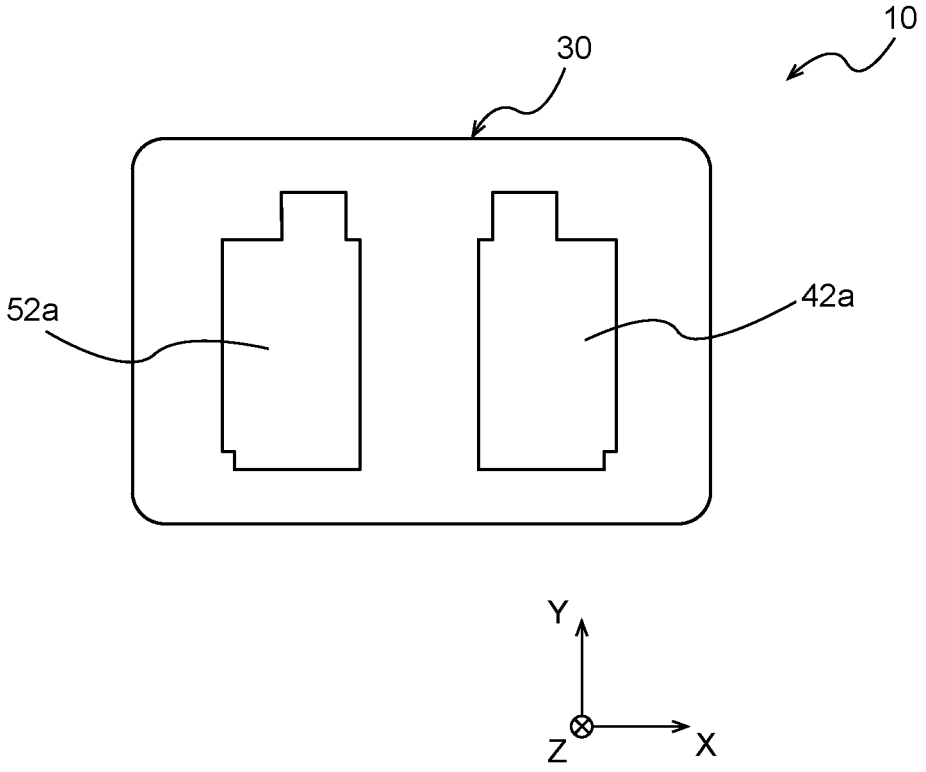
FIG. 4 is a bottom view of the coil device shown in FIG. 1.

As shown in FIG. 1, the coil device 10 has the outer shape of approximately rectangular parallelepiped shape. The outer circumference part of the coil device 10 is constituted by the magnetic part 30 expect for the mounting base faces 42*a* and 52*a* of the electrodes 40 and 50 which are exposed at the base face shown in FIG. 4. Therefore, in the actual coil device, the interior structure of the coil device 10 as shown in FIG. 4 cannot be observed from the outside.

Note that, for the description of the coil device 10, the direction which is perpendicular to the mounting face (the face where the mounting base face 42*a* opposes in FIG. 4) where the coil device 10 is mounted is defined as Z axis direction; and the direction which is perpendicular to Z axis direction and the is alignment direction of the pair of the electrodes 40 and 50 of the coil device 10 is defined as X axis direction; and the direction parallel to the symmetric axis of the pair of the electrodes 40 and 50 placed symmetrically is defined as Y axis direction.

As shown in FIG. 1, the winding coil 20 comprises the winding part 22 wound around the projection part 32*b* of the second magnetic part 38, and the extension line parts 24 and 26 which are pulled out from the winding part 22. The winding coil 20 is constituted by one continuous coated conductive wire, and the both ends of the winding coil 20 forms each extension line part 24 and 26.

The winding coil 20 is the coated conductive wire wherein the core material is Cu (copper). Note that, the core material of the winding coil 20 may include material other than Cu (for example, Ag (silver), Sn (tin) or so) in addition to Cu, and the core material may be a single wire or a twisted wire. Also, the diameter of the winding coil 20 is not particularly limited.

Also, as shown in FIG. 1, the winding part 22 of the winding coil 20 is wound around the projection part 32*b* of the first magnetic part 32; however the winding part 22 is not to be limited thereto. For example, at the inside of the winding part 22, as similar to the outside of the winding part 22, the second magnetic part 38 may be placed.

A pair of the electrodes 40 and 50 included in the coil device 10 is arranged near the base part of the coil device 10 as shown in FIG. 1. The electrode 40 and the electrode 50 have an approximately symmetric shape against each other, and are placed approximately symmetrically across the symmetric axis.

As shown in FIG. 1, the electrode 40 comprises the connecting wire part 46 where the extension line part 24 of the winding coil 20 is connected, and the base part 42 connected to the connecting wire part 46. As shown in FIG. 4, at one face of the base part 42, that is at the face which is facing the negative direction of Z axis of the base part 42, the mounting base face 42*a* is provided.

As shown in FIG. 4, the mounting base face 42*a* of the electrode 40 is exposed from the magnetic part 30. When the coil device 10 is mounted on substrate or so, the coil device 10 is provided so that the mounting base face 42*a* is facing the land formed on the substrate, and then bonded to the land of the substrate via the solder or so. As it will be described in below, the Sn (tin) layer is formed to the mounting base face 42*a* in order to enhance the bonding property when mounting.

Figure 3:
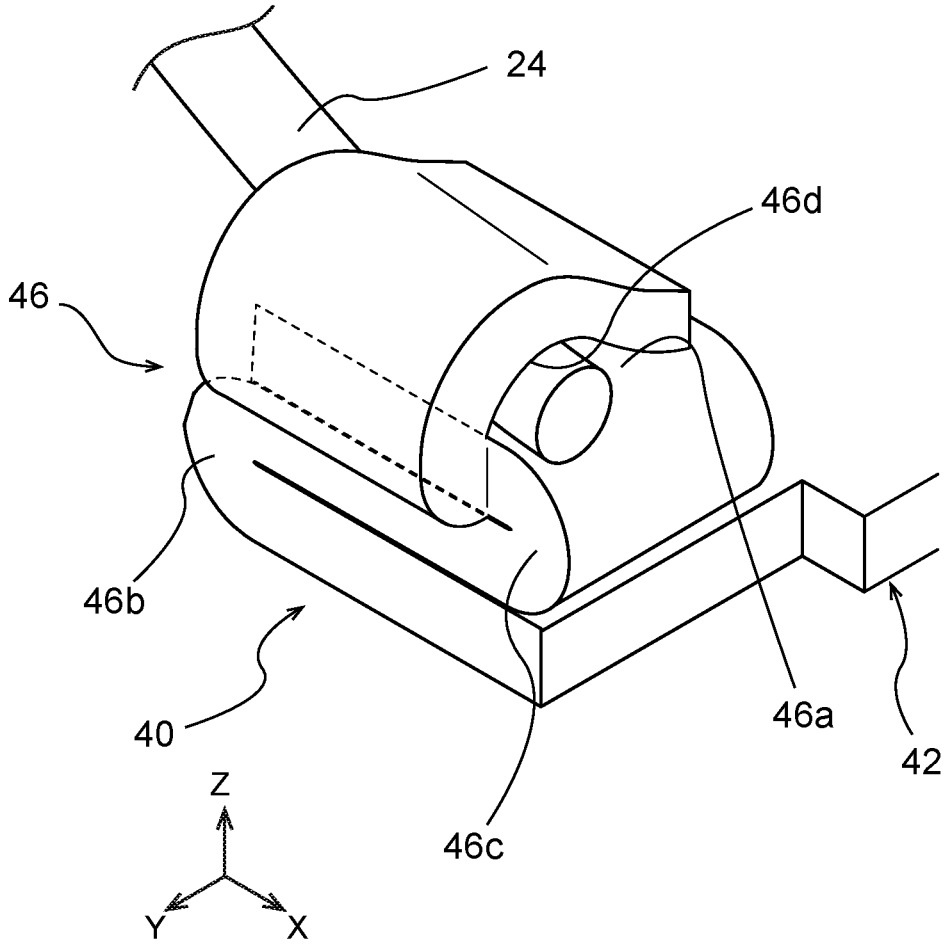
FIG. 3 is a partial enlarged view wherein the surrounding area of the connecting part of the coil device shown in FIG. 1 is enlarged.
Figure 5A:
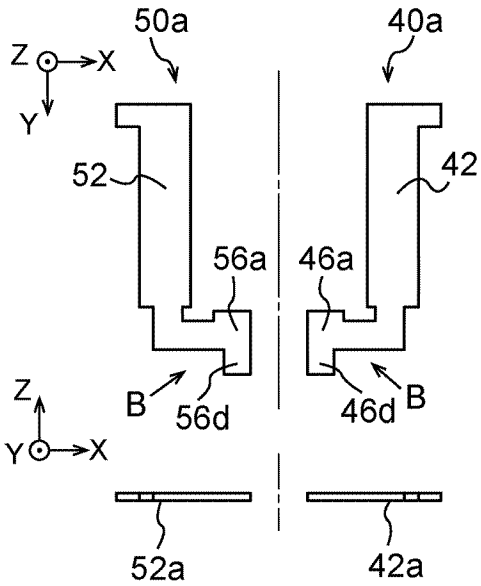
FIGS. 5A-5C are conceptual diagrams showing one example of the production method of the electrode of the coil device shown in FIG. 1.
Figure 5B:
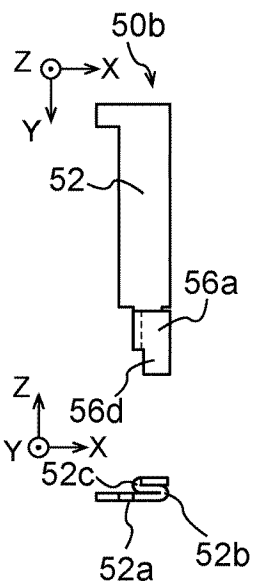
Figure 5C:
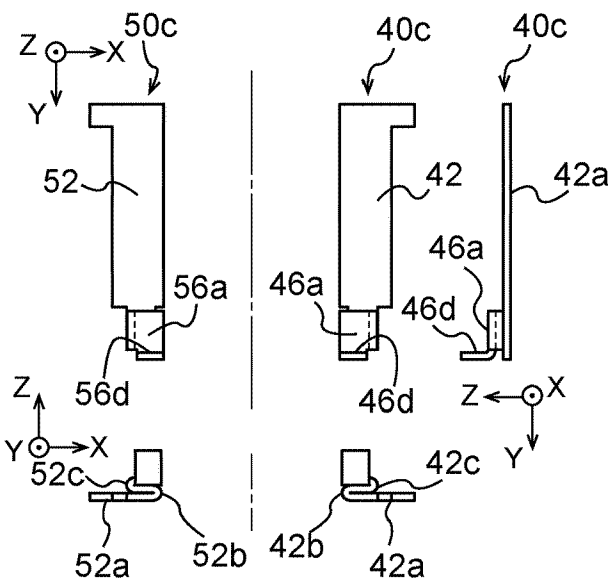

As it can be understood from FIG. 5C showing the electrodes 40*c* and 50*c* of before connecting, the connecting wire part 46 of the electrode 40 projects out to the positive direction of Z axis which is the opposite of the mounting base face 42*a* with respect to the base part 42. As shown in FIG. 3 of the enlarged view of the connecting wire part 46, the connecting wire part 46 comprises the connecting wire face 46*a* where the extension line part 24 of the winding coil 20 is connected, and the protective face 46*d* sandwiching the extension line part 24 with the connecting wire face 46*a*. The extension line part 24 is fixed to the connecting wire face 46*a* by for example a welding or so; however the method of connecting the extension line part 24 to the connecting wire face 46*a* is not particularly limited.

The connecting wire face 46*a* is facing the positive direction of Z axis. The connecting wire face 46*a* is approximately parallel with the mounting base face 42*a* formed on the base part 42, but the direction is opposite. The protective face 46*d* is bended, thus the direction of the protective face 46*d* changes depending on its position. Note that, the protective face 46*d* by in large faces the negative direction side of Z axis.

The protective face 46*d* is bended so as to cover the extension line part 24*a* in a circumference direction (the direction surrounding the cross section which is perpendicular to the stretching direction of the extension line part 24*a*), and the extension line part 24*a* is placed between the connecting wire face 46*a* and the protective face 46*d*. The protective face 46*d* is continuous in seamless manner with the connecting wire face 46*a* without having the bonding part in between.

As shown in FIG. 3, the connecting wire part 46 comprises the bending parts 46*b* and 46*c*. The connecting wire face 46*a* provided on the upper face of the connecting wire part 46 is continuous with the base part 42 via the bending parts 46*b* and 46*c*. The connecting wire part 46 comprises two bending parts 46*b* and 46*c*; however the number of the bending part comprised by the connecting wire part 46 is not particularly limited.

Figure 2:
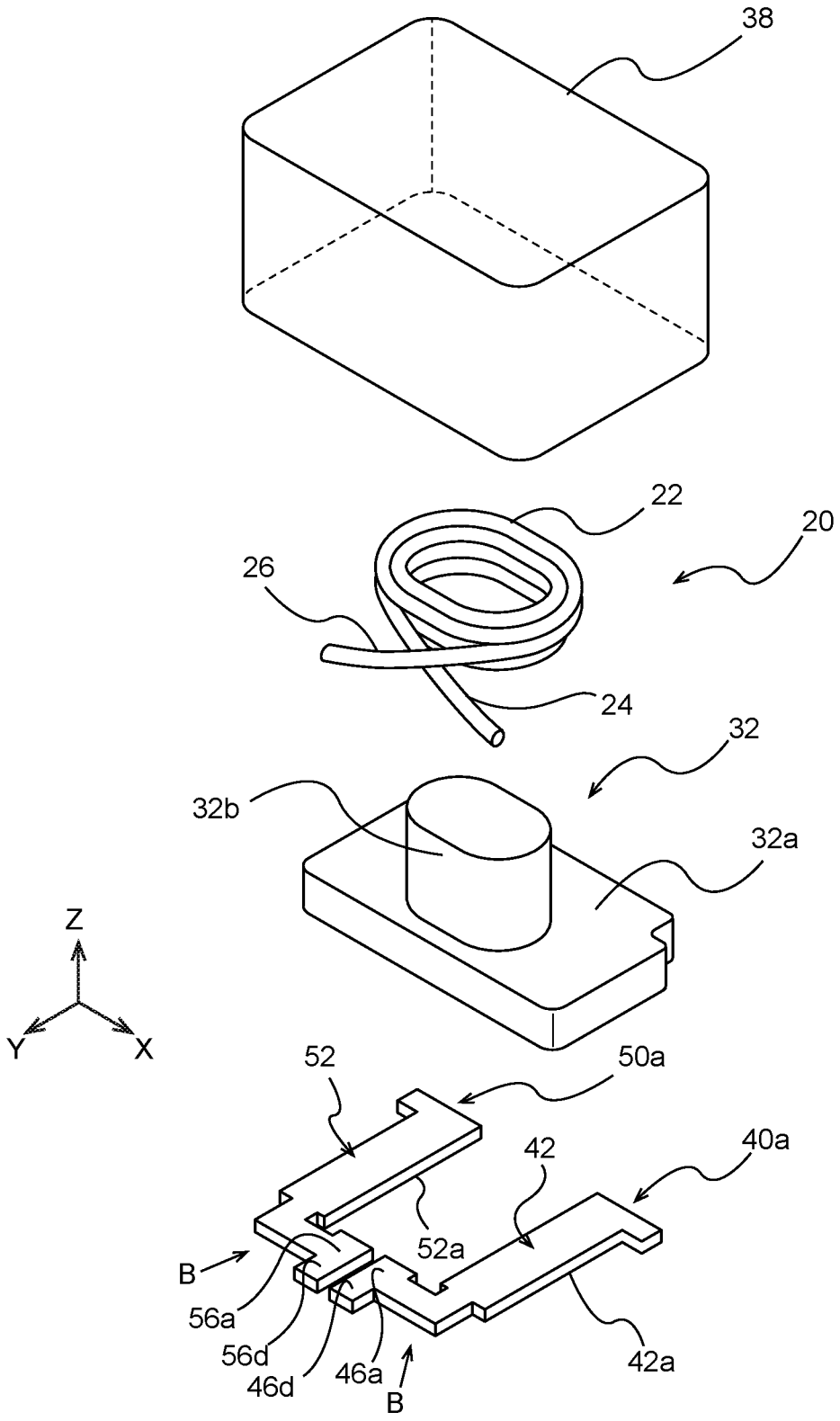
FIG. 2 is a exploded perspective view of the coil device shown in FIG. 1.

FIG. 2 is the exploded perspective view of the coil device 10. In the electrode 40*a* shown in FIG. 3, the bending parts 46*b* and 46*c* are stretched and the electrode 40 is opened to a planar form. When the electrode 40*a* is opened, the mounting base face 42*a* is formed on one face of the electrode 40*a*, and on the other hand, the connecting wire face 46*a* and the protective face 46*d* are formed to the other face of the electrode 40*a* which is the opposite face where the mounting base face 42*a* is formed. Therefore, in the electrode 40*a* being opened, the mounting base face 42*a* and the connecting wire face 46*a* are facing the opposite direction against each other.

The electrode 40 is made of the conductive material, and comprises the substrate constituted by the alloy including Cu (copper) or alloy including Cu, the Ni layer including Ni (nickel) and the Sn layer including Sn (tin) which are formed on the substrate surface. Here, the Sn layer of the electrode 40 is not formed equally on the entire surface of the electrode 40, and the Sn layer is formed differently at least between the mounting base face 42*a* and the connecting wire face 46*a*.

That is, in the electrode 40, the amount of Sn per unit area in the connecting wire face 46*a* is less than the amount of Sn per unit area of the mounting base face 42*a* shown in FIG. 4. Here, the amount of Sn per unit area is expressed as the product between the thickness of the outer most surface, and the content ratio of Sn of the outer most surface constituting the connecting wire face 46*a* and the mounting base face 42*a*.

Figure 7A:
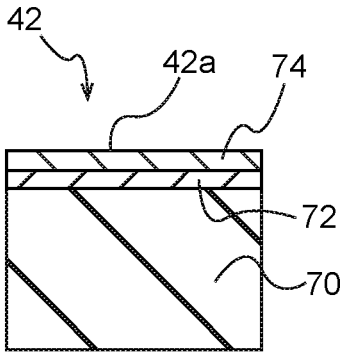
FIGS. 7A-7D are schematic cross sections showing the cross section of the connecting wire part included in the coil device according to the embodiment and a modified example.
Figure 7B:
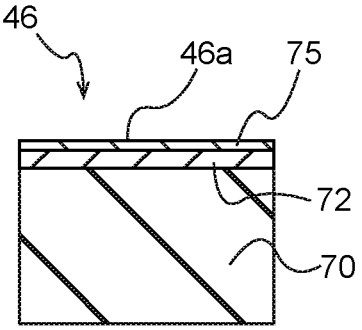

As shown in FIG. 7A of the schematic cross section of the base part 42, at the mounting base face 42*a*, the Ni layer 72 is formed as the foundation layer on the surface of the substrate 70, and the Sn layer 74 is formed on the Ni layer 72. On the other hand, as shown in FIG. 7B of the schematic cross section of the connecting wire part 46, and at the connecting wire face 46*a*, the Ni layer 72 and the Sn layer 75 are formed by stacking on the surface of the substrate 70, and the Sn layer 75 of the connecting wire face 46*a* is thinner than the Sn layer 74 of the mounting base face 42*a*. As shown in FIG. 7A and FIG. 7B, in case the mounting base face 42*a* and the connecting wire face 46*a* are constituted by Sn layer constituted only by Sn, then the thickness of Sn layer 75 constituting the connecting wire face 46*a* is thinner than the Sn layer 74 constituting the mounting base face 42*a*.

Figure 7C:
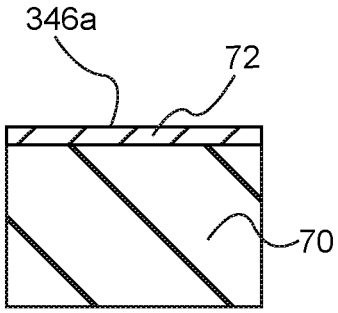
Figure 7D:
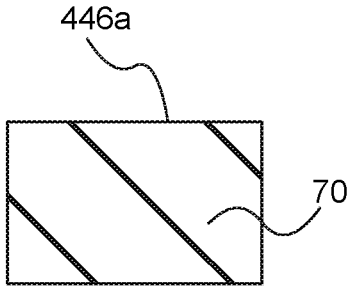

Also, preferably Sn is present in the mounting base face 42*a*, however Sn is not necessarily needed in the connecting wire face 46*a*. For example, as the connecting wire face 346*a* shown in FIG. 7C, the connecting wire face 346*a* may be constituted by Ni layer 72, and also as the connecting wire face 446*a* shown in FIG. 7D, the connecting wire face 446*a* may be constituted by the surface of the substrate itself made of Cu or so. Also, the connecting wire face may be constituted by the Ag layer including Ag (silver). In the present embodiment, the electrode 40 comprises the metal terminal and the conductor layer having the conductive property formed on the surface of the metal terminal, however the electrode 40 is not limited thereto; and it may be those combined with the conductor layer (the paste layer or so) of the single layer or the multilayer formed to the magnetic material, and the metal terminals or so connecting thereto. Note that, the material of the substrate 70 of the metal terminal of the electrode 40 only needs to be a conductive material, and it is not limited to Cu or Cu alloy. Also, each layer can be formed by for example an electroplating, an electroless plating, a vapor deposition or a spattering or so, however the method of forming the Sn layers 74 and 75, and the Ni layer 72 are not particularly limited.

The electrode 50 shown in FIG. 1 is the same as the electrodes 40 and 40*a* except that the shape is symmetrical of the electrodes 40 and 40*a*, thus the detail description will be omitted. The electrode 50 comprises the connecting wire part 56 having the connecting wire face 56*a* (see FIG. 2), the protective face 56*a* and the bending parts 56*b* and 56*c*, and the base part 42 provided with the mounting base face 52*a*. The base part 52 and the connecting wire part 56 of the electrode 50 correspond to the base part 42 and the connecting wire part 46 of the electrode 40.

As shown in FIG. 1, the magnetic part 30 comprises the first magnetic part 32, and the second magnetic part 38 covering the winding part 22 and the connecting wire faces 46 and 56. The first magnetic part 32 comprises the planar part 32*a* approximately parallel with the base parts 42 and 52 of the electrodes 40 and 50, and the projection part 32*b* of the columnar shape projecting out towards the positive direction of Z axis from the planar part 32*a*.

At least part of the projection part 32*b* which is a part of the first magnetic part 32 is positioned at inside of the winding part 22, and the planar part 32*a* which is other part of the first magnetic part 32 is positioned between the winding part 22 and the base parts 42 and 52 of the electrodes 40 and 50. The extension line parts 24 and 26 passes through the positive direction side of X axis of the planar part 32*a* and extends to the connecting wire faces 46*a* and 56*a*.

The second magnetic part 38 covers the electrodes 40 and 50, the first magnetic part 32 and the winding coil 20 except for the mounting base faces 42*a* and 52*a*. Note that, a part of the electrodes 40 and 50 excluding the mounting base faces 42*a* and 52*a*, the first magnetic part 32, and a part of the winding coil 20 may be exposed from the second magnetic part 38.

The first magnetic part 32 is constituted by the sintered body or the molded body of a magnetic member including the magnetic material such as Ni—Zn based ferrite, Mn—Zn based ferrite and metals or so. The second magnetic part 38 is constituted by the material wherein the resin and the magnetic material such as ferrite or so are mixed. The first magnetic part 32 preferably comprises larger content of the magnetic material per unit area than the second magnetic part 38.

Herein below, the production method of the coil device 10 shown in FIG. 1 will be shown as one example; however the production method of the coil device 10 is not limited thereto.

In the production of the coil device 10, the first the electrodes 40*a* and 50*a* shown in FIG. 2, and the first magnetic part 32 are prepared, and then the first magnetic part 32 is provided on the electrodes 40*a* and 50*a*. The first magnetic part 32 is preferably fixed on the upper face of the electrodes 40*a* and 50*a* by an adhesion or so. The first magnetic part 32 is formed by sintering the magnetic material such as ferrite or so, and the electrodes 40*a* and 50*a* are formed by mechanically processing the copper board or so which is formed with the Sn layer and the Ni layer (or by forming the Sn layer and the Ni layer on the copper board being mechanically processed). Note that, during the step of providing the first magnetic part 32 on the electrodes 40*a* and 50*a*, the electrodes 40*a* and 50*a* may be under the condition of the lead frame wherein numerous electrodes 40*a* and 50*a* are connected.

Also, before or after the step of proving the first magnetic part 32 on the electrodes 40*a* and 50*a*, the arm parts (see arrow A shown in FIG. 2) of the electrodes 40*a* and 50*a* are bended to form the bending parts 46*b*, 46*c*, 56*b* and 56*c* as shown in FIG. 1 and FIG. 3 are obtained.

FIGS. 5A-5C are conceptual diagrams showing the method of forming the bending parts 46*b*, 46*c*, 56*b*, and 56*c* to the electrodes 40*a* and 50*a*. The flat electrodes 40*a* and 50*a* shown in FIG. 5A are carried out with the process of bending the arm part B for twice in X axis direction. Thereby, the electrodes 40*b* and 50*b* comprising the bending parts 46*b*, 46*c*, 56*b*, and 56*c* as shown in FIG. 5B is obtained. Further, for the electrodes 40*b* and 50*b* shown in FIG. 5B, the protective faces 46*d* and 56*d* are bended 90 degrees angle with respect to the connecting wire faces 46*a* and 56*a*, thereby the electrodes 40*c* and 50*c* shown in FIG. 5C is obtained.

Note that, the connecting wire parts 46 and 56 shown in FIG. 1 comprises the bending parts 46*b*, 46*c*, 56*b*, and 56*c* formed by bending once in positive and negative direction of X axis respectively; however the connecting parts 46 and 56 are not limited thereto, and it may comprise the bending part formed by bending in Y axis direction, furthermore it may be bended for even number of times of four or more times.

Furthermore, as shown in FIG. 1, the winding part 22 is formed by winding the conductive wire around the projection part 32*b* of the first magnetic part 32, then the extension line parts 24 and 26 which are the both ends of the coated conductive wire are connected respectively to the connecting wire faces 46*a* and 56*a*, thereby the winding coil 20 is formed. The method of connecting the extension line parts 24 and 26 to the connecting wire faces 46*a* and 56*a* are not particularly limited, and for example it is done by the thermocompression bonding and the welding or so. Further, by bending the protective faces 46*d* and 56*d* of the electrodes 40*c* and 50*c* to cover the connecting part of the extension line parts 24 and 26, the connecting wire parts 46 and 56 shown in FIG. 3 may be formed.

Also, as other method for connecting the extension line parts 24 and 26 to the connecting wire faces 46*a* and 56*a*, the method of temporarily fixing the extension line parts 24 and 26 using the protective faces 46*d* and 56*d* to the connecting wire faces 46*a* and 56*a*, then fixing the extension line parts 24 and 26 to the connecting wire faces 46*a* and 56*a* by thermocompression bonding or welding may be mentioned. In this case, by bending the protective faces 46*d* and 56*d* and sandwiching the extension line parts 24 and 26, the extension line parts 24 and 26 can be easily fixed temporarily to the connecting wire faces 46*a* and 56*a*, and also the actual fixing of the extension line parts 24 and 26 to the connecting wire faces 46*a* and 56*a* can be stably done, thus the production is easy.

Further, after covering the connecting wire faces 46 and 56, and the winding coil 20 made by the paste including the magnetic material and the resin, a drying and a heat treatment are carried out, and thereby the second magnetic part 38 is formed. The step of forming the second magnetic part 38 by covering the winding coil 20 and the connecting wire faces 46 and 56 may be carried out at once for plurality of the coil devices 10, and in such case it is cut into pieces after the covering step, thereby the coil device 10 is obtained. Also, the step of forming the second magnetic part 38 may be carried out per one coil device as shown in FIG. 1.

In the coil device 10 as described in above, the magnetic part 30 covers the connecting wire parts 46 and 56, and the magnetic part 30 protects the connecting wire parts 46 and 56 from the impacts from the outside, thus the coil device 10 has good durability and reliability. Further, the extension line parts 24 and 26 are placed between the protective faces 46*d* and 56*d* and the connecting wire faces 46*a* and 56*a*, therefore compared to the case without the protective faces 46*d* and 56*d*, the area in contact with the magnetic part 38 with respect to the connecting wire part of the extension line parts 24 and 25 are reduced. Therefore, the coil device 10 can prevent the force trying to pull the connecting part away from the electrodes 40 and 50 with respect to the connecting part of the extension line parts 24 and 25 of the connecting magnetic part 30, which is caused by the linear expansion coefficient difference or so. Also, the protective faces 46*d* and 56*d* has an effect to protect the connecting part between the extension line parts 24 and 26 and the electrodes 40 and 50 from the being released due to the residual stress caused during the molding for covering the connecting parts 46 and 56 by the second magnetic part 38. Therefore, the coil device 10 has high reliability regarding the connecting condition between the winding coil 20 and the electrodes 40 and 50.

Also, as shown in FIG. 1 and FIG. 3, the protective faces 46*d* and 56*d* are bended so as to cover the extension line parts 24 and 26 in the circumference direction, and the extension line parts 24 and 26 are placed between the connecting wire faces 46*a* and 56*a* and the protective faces 46*d* and 56*d*. Thus, the connecting part of the extension line parts can be suitably protected. Also, the connecting wire faces 46*a* and 56*a* and the protective faces 46*d* and 56*d* are continuous, therefore in other words, the connecting wire faces 46*a* and 56*a* and the protective faces 46*d* and 56*d* are formed by bending one planar board material. Therefore, at the connecting wire parts 46 and 56, by holding the extension line parts 24 and 26 in between the protective faces 46*d* and 56*d* and the connecting wire faces 46*a* and 56*a*, the connecting condition between the winding coil 20 and the electrodes 40 and 50 can be enhanced. Also, by using the continuous connecting wire faces 46*a* and 56*a* and the protective faces 46*d* and 56*d*, the extension line parts 24 and 26 can be easily fixed temporarily to the connecting wire faces 46*a* and 56*a*, hence such coil device 10 can be produced easily.

Further, in the coil device 10, as shown in FIG. 7A, at least part of the electrodes 40 and 50 are formed with the Sn layer including Sn, and the mounting base faces 42*a* and 52*a* are constituted by the Sn layer. Therefore, the mounting base faces 42*a* and 52*a* of the coil device 10 has good bonding property with the solder, thus it is suited for the surface mounting.

Note that, since Sn has low melting point, if the amount of Sn of the connecting wire faces 46*a* and 56*a* are large as similar to the mounting base faces 42*a* and 52*a*, then the Sn layer of the connecting wire faces 46*a* and 56*a* melts when applying the heat during the reflow for mounting the coil device 10 to the substrate or so; which may deteriorate the bonding condition of the connecting wire faces 46*a* and 56*a* with the second magnetic part 38 or the extension line parts 24 and 26. Further, if the amount of Sn of the connecting wire faces 46*a* and 56*a* are large, the alloy layer of Sn—Cu having a low melting point may be formed to relatively large area when carrying out the thermocompression bonding or welding of the extension line parts 24 and 26 to the connecting wire faces 46*a* and 56*a*. The presence of such alloy layer may worsen the deterioration of the bonding condition between the connecting wire faces 46*a* and 56*a* with the second magnetic part 38 or the extension line parts 24 and 26 which is caused by the heat of the reflow.

However, in the coil device 10 shown in FIG. 1, the extension line parts 24 and 26 are placed between the protective faces 46*d* and 56*d* and the connecting wire faces 46*a* and 56*a*, hence the deterioration of the bonding condition of the winding coil 20 and the electrodes 40 and 50 which is caused by the above mentioned problems can be prevented.

Also, in the coil device 10 shown in FIG. 1, the amount of Sn per unit area of the connecting wire faces 46*a* and 56*a* is less than the mounting base faces 42*a* and 52*a*. Thereby, the coil device 10 can prevent the problems which occurs along with the melting of Sn and Sn alloy of the connecting wire faces 46*a* and 56*a*, such as the deterioration of the bonding condition of the connecting wire faces 46*a* and 56*a* with the extension line parts 24 and 26, and between the connecting wire faces 46*a* and 56*a* with the magnetic part 30, and also the disconnection of the bonding can be prevented. Further, the cracks to the magnetic part 30 can be avoided, and the winding coil 20 and the electrodes 40 and 50 unable to secure the conductance can be avoided as well. Therefore, the coil device 10 has high reliability and the stable performance.

Also, the connecting wire faces 46*a* and 56*a* projects out to the opposite side of the mounting base faces 42*a* and 52*a* with respect to the base parts 42 and 52, hence the coil device 10 allows avoiding the extension line parts 24 and 26 from being pulled out too much from the winding part 22 to the base parts 42 and 52, and the length of the extension line parts 24 and 26 are shortened. Therefore, such coil device 10 can reduce the stress applied from the magnetic part 30 to the bonding parts between the extension line parts 24 with the connecting line faces 46*a* and 56*a*. Thus, from this point as well, the deterioration of the bonding condition between the connecting wire faces 46*a* and 56*a* with the extension line part 24 and the magnetic part 30 can be prevented.

Also, the electrodes 40 and 50 shown in FIG. 2 are formed as one body from one board material by mechanically processing the board material of the planar form to form the bending parts 46*b*, 46*c*, 56*b* and 56*c*. Therefore, the electrodes 40 and 50 formed as such can be easily produced because there is no bonding parts in the electrodes 40 and 50, thus has excellent productivity.

Further, when the electrodes 40 and 50 are opened as shown in FIG. 2 and FIG. 5A, the mounting base faces 42*a* and 52*a* and the connecting wire faces 46*a* and 56*a* are facing the opposite direction against each other. Therefore, the surface layer having different Sn amount can be easily formed on each face. For example, to one face of the cupper board, a plating layer having two layers of Ni layer and Sn layer is formed, and the plating layer is not formed on the other face of the copper board so that the surface of the copper board as the substrate is uncovered, thereby the mounting base faces 42*a* and 52*a*, and the connecting wire faces 46*a* and 56*a* having different Sn amount can be formed easily.

Also, in the coil device 10 wherein the connecting wire faces 46*a* and 56*a* are approximately parallel with the mounting base faces 42*a* and 52*a*, the step of connecting the extension line pairs 24 and 26 to the connecting wire faces 46*a* and 56*a* can be done easily. That is, the connecting wire faces 46*a* and 56*a* are facing the upper side (the positive direction of Z axis), hence the heating member for the thermocompression bonding can be pressed against the connecting wire faces 46*a* and 56*a* by approaching from the upper side of the extension line parts 24 and 26, thereby the connection to the electrodes 40 and 50 of the winding coil 20 can be done. Therefore, such coil device 10 has excellent productivity.

Also, the magnetic part 30 comprises the first magnetic part 32 which does not need to cover other parts, hence the characteristics of the coil device 10 can be improved by reducing the amount of resin included in the first magnetic part 32 with respect to the second magnetic part 38, and also by increasing the content of the magnetic material.

Hereinabove, the coil device 10 according to the present invention was explained using the embodiment, however the coil device 10 is only one example of the present invention, and various modified examples different from the coil device 10 are included within the scope of the present invention.

Figure 6A:
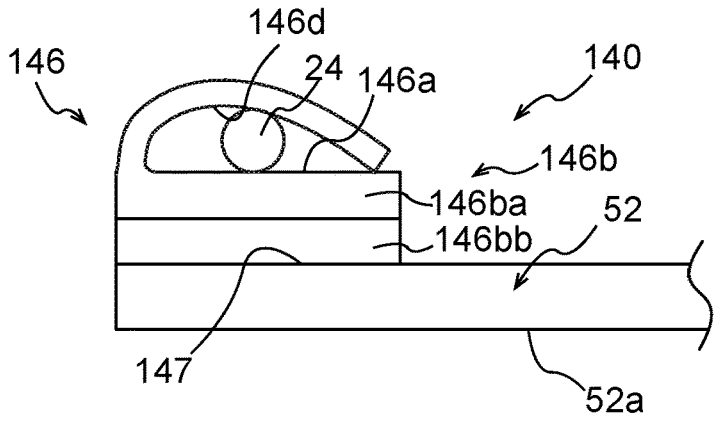
FIGS. 6A-6C are partial enlarged views of the connecting wire part of the electrode included in the coil device according to the modified example.
Figure 6B:
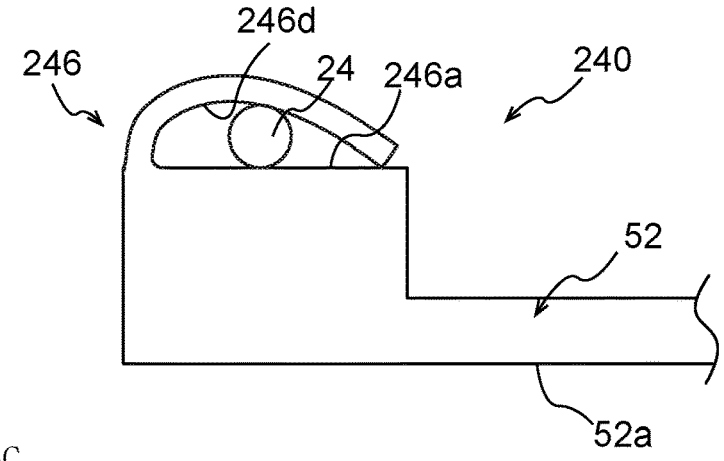
Figure 6C:
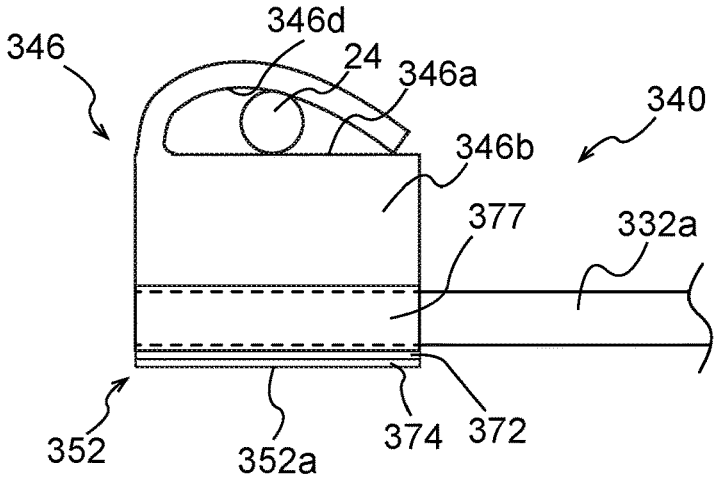

FIG. 6A is the partial enlarged view of the connecting wire part 146 of the electrode 140 according to the first modified example, FIG. 6B is the partial enlarged view of the connecting wire part 246 of the electrode 240 according to the second modified example, and FIG. 6C is the partial enlarged view of the connecting wire part 346 of the electrode 340 according to the third modified example. The electrodes 140 and 240 according to the first and the second examples are same as the electrode 40 according to the present embodiment except for having different structure of the connecting wire parts 146 and 246, thus the description regarding the same parts will be omitted.

The connecting wire parts 146 of the electrode 140 shown in FIG. 6A comprises the conductor piece 140*d* made of the conductive material, and provided with the connecting wire face 146*a* and the protective face 146*d*. The conductor piece 146*d* bonds the pieces 146*ba* and 146*bb* made of Cu or Cu alloy, and by bending part of it, those having the connecting wire face 146*a* and the protective face 146*d* which covers the extension line part 24 can be used. The conductor piece 146*b* comprises two pieces of 146*ba* and 146*bb* stacked in Z axis direction, and the two pieces 146*ba* and 146*bb* are bonded by adhesion or welding or so. Note that, the number of the pieces 146*ba* and 146*bb* included in the conductor piece 146*b* may be one or it may be three or more.

The conductor piece 146*b* is fixed to the base part 52 via the bonding part 147 bonding the conductor piece 146*b* and base part 52. The bonding part 147 is for example constituted from the welding part in case the conductor pieces 146 and the base part 52 are welded, and the bonding part 147 is constituted from the adhesion part in case the conductor pieces 146 and the base part 52 are adhered.

As similar to the electrode 40 shown in FIG. 1, the amount of Sn per unit area of the connecting wire face 146*a* is less than that in the mounting base face 52*a*. In such electrode 140, the conductor pieces 146*b* provided with the connecting wire face 146*a*, and the base part 52 where the mounting base face 52 a is mounted are separate parts, hence for example by bonding the conductor piece 146*b* after forming Sn layer on the mounting base face 52*a*, the connecting wire face 146*a* and the mounting base face 52*a* having different amount of Sn against each other can be easily formed. Note that, from the point that the connecting wire face 146*a* is provided by projecting out to the positive direction of Z axis with respect to the base part 52, it is the same as the electrode 40 shown in FIG. 1.

The electrode 240 shown in FIG. 6B comprises the substrate having thick part which is thicker than the other parts of the substrate, and the thick part constitutes the connecting wire part 246. In the electrode 240, as the electrode 40 shown in FIG. 1, the amount of Sn per unit area of the connecting wire face 246*a* is less than that in the mounting base face 52*a*. In such electrode 240, the face provided with the connecting wire face 246*a* and the face provided with the mounting base face 52*a* are facing the opposite direction, therefore the connecting wire face 246*a* and the mounting base face 52*a* having different amount of Sn can be easily formed. Note that, from the point that the connecting wire face 246*a* is provided by projecting out to the positive direction of Z axis with respect to the base part 52, and the extension line part 24 is placed between the protective face 246*d* and the connecting wire face 246*a*, it is the same as the electrode 40 shown in FIG. 1.

The connecting wire part 346 of the electrode 340 shown in FIG. 6C comprises the conductor piece 346*b* provided with the connecting wire face 346*a* and is made of conductive material. Also, the base part 352 of the electrode 340 comprises, the Ag part 377 including Ag which is a paste electrode formed to the planar part 332*a* of the first magnetic part, the Ni layer 372 including Ni, and the Sn layer including Sn. The Sn layer 374 is bonded to the Ag part 377 via the Ni layer 372. The mounting base face 352*a* is constituted by the Sn layer 374 formed at the outer most face.

In such electrode 340, the base part 352 including paste electrode or so, and the conductor piece 346*b* provided with the connecting wire face 346*a* are separate parts, hence the connecting wire face 346*a* and the mounting base face 352*a* having different amount of Sn against each other can be easily formed. Note that, from the point that the connecting wire face 146*a* is provided by projecting out to the positive direction of Z axis with respect to the base part 52, and the extension line part 24 is placed between the protective face 346*d* and the connecting wire face 346*a*, it is the same as the electrode 40 shown in FIG. 1.

Figure 8A:
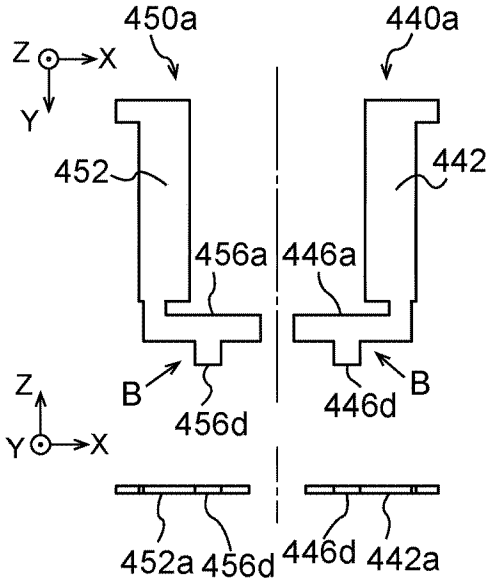
FIGS. 8A-8C are conceptual diagrams showing one example of the production method of the electrode according to the modified example.
Figure 8B:
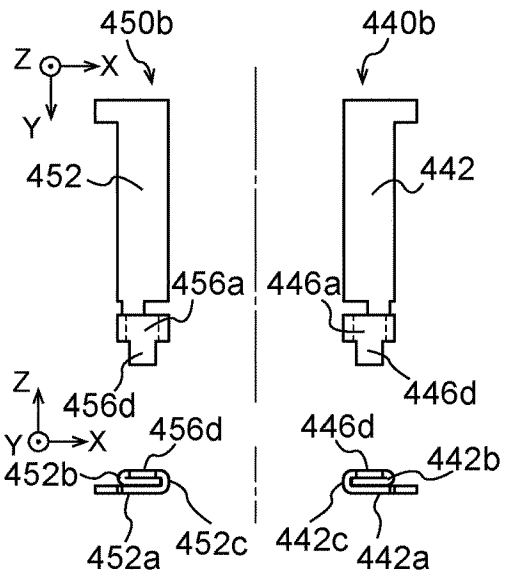
Figure 8C:
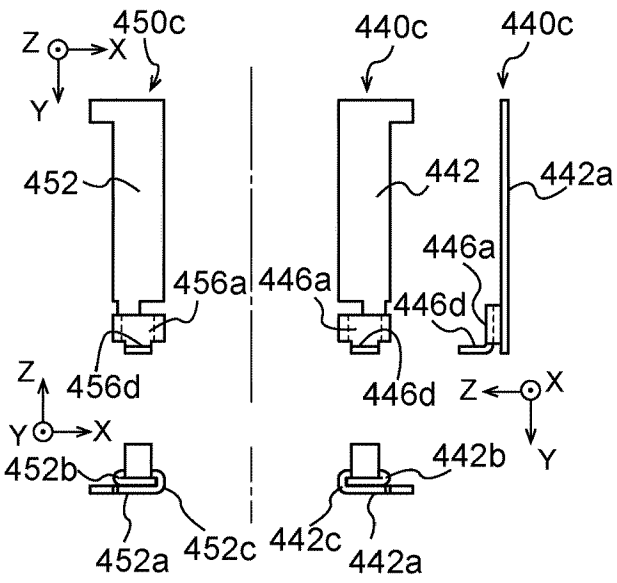

FIGS. 8A-8C are the conceptual diagrams showing the method of forming the bending parts 446*b*, 446*c*, 456*b* and 456*c* to the pair of electrodes 440*a* and 450*a* according to the fourth modified example. In the fourth modified example, the electrodes 440*a* and 450*a* having a flat shape as shown in FIG. 8A are prepared. The electrodes 440*a* and 450*a* are produced by mechanically processing the substrate constituted by Cu or Cu alloy, then forming the Ni layer and Sn layer to the part corresponding to the mounting base faces 442*a* and 452*a*. Note that, under the opened condition as shown in FIG. 8A, the mounting base faces 442*a* and 452*a* are facing the same direction (the negative direction of Z axis) as the connecting wire faces 446*a* and 456*a* and the protective faces 446*d* and 456*d*.

First, the electrodes 440*a* and 450*a* shown in FIG. 5A are bended for twice so as to wrap the tip of the arm part. Thereby, the electrodes 440*b* and 450*b* comprising the bending parts 446*b*, 446*c*, 456*b* and 456*c* as shown in FIG. 5B are obtained. In the electrodes 440*a* and 450*a* shown in FIG. 5A, the connecting wire faces 446*a* and 456*a* which are facing the same direction as the mounting base faces 442*a* and 452*a* are facing the opposite direction (the positive direction of Z axis) of the mounting base faces 442*a* and 452*a* in the electrodes 440*b* and 450*b* shown in FIG. 5B. For the electrodes 440*b* and 450*b* shown in FIG. 5B, the protective faces 446*d* and 456*d* are bended 90 degrees with respect to the connecting wire faces 446*a* and 456*a*, thereby the electrodes 440*c* and 450*c* shown in FIG. 5C are obtained.

The electrodes 440*c* and 450*c* produced as shown in FIGS. 8A-8C can be used as the electrodes of the coil device according to the present invention as same as the electrodes 40*c* and 50*c* shown in FIG. 5C.

NUMERICAL REFERENCES

10 . . . Coil device
20 . . . Winding coil
22 . . . Winding part
24, 26 . . . Extension line part
30 . . . Magnetic part
32 . . . First magnetic part
32*a* . . . Planar part
32*b* . . . Projection part
38 . . . Second magnetic part
40 50, 140, 240 . . . Electrode
42, 52 . . . Base part
42*a*, 52*a* . . . Mounting base face
46, 56, 146, 246, 346 . . . Connecting wire part
46*a*, 56*a*, 346*a*, 346*a*, 446*a*, 546*a* . . . Connecting wire face
46*b*, 46*c*, 56*b*, 56*c* . . . Bending part
46*d*, 56*d* . . . Protective face
147 . . . Bonding part
70 . . . Substrate
72 . . . Ni layer
74, 75 . . . Sn layer
377 . . . Ag part

The invention claimed is:

1. A coil device comprising;

a winding coil including Cu and having a winding part and first and second extension line parts extending from the winding part, a pair of electrodes made of a conductive material, each of the pair of electrodes having (1) a connecting wire part having a connecting wire face connected with one of the first and second extension line parts and a protective face sandwiching the one of the first and second extension line parts with the connecting wire face and (2) a base part provided with a mounting base face at one of the faces of the base part and connected to the connecting wire part, and a magnetic part including a magnetic material and covering all of the winding part, the first and second extension line parts and the connecting wire part of the pair of electrodes, wherein:

the mounting base face is exposed to an exterior of the coil device, the connecting wire part comprises a bending part, the connecting wire face is connected to the base part via the bending part, the connecting wire face is approximately parallel with the mounting base face, and the connecting wire face is facing an opposite direction from the mounting base face.

2. The coil device as set forth in claim 1, wherein the protective face is bended so as to cover the extension line part in a curved circumference direction and the protective face is continuous with the connecting wire face.

3. The coil device as set forth in claim 1, wherein the connecting wire part has a conductor piece made of a conductive material and provided with the connecting wire face, and the conductor piece is fixed to the base part via a bonding part.

4. The coil device as set forth in claim 1, wherein at least part of the each of the pair of electrodes is formed with Sn layer including Sn, and the mounting base face is constituted by the Sn layer.

5. The coil device as set forth in claim 1, wherein the connecting wire part has a conductor piece made of a conductive material and provided with the connecting wire face, the base part has Ag part including Ag, Ni layer including Ni, and Sn layer including Sn, and the Sn layer is bonded to the Ag part via the Ni layer, and the mounting base face is constituted by said Sn layer.

6. The coil device as set forth in claim 1, wherein the magnetic part has a first magnetic part of which a first part is positioned at inside of the winding part and a second part is positioned between the winding part and the base part, and a second magnetic part covering the winding part and the connecting wire face, and the first magnetic part has more content of magnetic material per unit area than the second magnetic part.

7. The coil device as set forth in claim 1, wherein the mounting base face is constituted by a first Sn layer including Sn, and the connecting wire face is constituted by a second Sn layer which is thinner than the first Sn layer of the mounting base face, or is not constituted by the first Sn layer.

* * * * *